US008381845B2

(12) United States Patent
Lockwood

(10) Patent No.: US 8,381,845 B2
(45) Date of Patent: Feb. 26, 2013

(54) INFILTRATED CARBIDE MATRIX BODIES USING METALLIC FLAKES

(75) Inventor: Gregory T Lockwood, Pearland, TX (US)

(73) Assignee: Smith International, Inc., Houston, TX (US)

( * ) Notice: Subject to any disclaimer, the term of this patent is extended or adjusted under 35 U.S.C. 154(b) by 325 days.

(21) Appl. No.: 12/706,971

(22) Filed: Feb. 17, 2010

(65) Prior Publication Data

US 2010/0206639 A1 Aug. 19, 2010

Related U.S. Application Data

(60) Provisional application No. 61/153,142, filed on Feb. 17, 2009.

(51) Int. Cl.
*E21B 10/36* (2006.01)
*B22F 1/00* (2006.01)

(52) U.S. Cl. ..... 175/425; 175/432; 175/428; 75/252

(58) Field of Classification Search ..... 75/252; 175/425, 432, 428
See application file for complete search history.

(56) References Cited

U.S. PATENT DOCUMENTS

| | | | | |
|---|---|---|---|---|
| 3,379,503 | A | 4/1968 | McKenna | |
| 4,689,242 | A * | 8/1987 | Pike | 427/451 |
| 4,723,996 | A | 2/1988 | Brunet et al. | |
| 4,834,963 | A | 5/1989 | Terry et al. | |
| 4,863,516 | A * | 9/1989 | Mosser et al. | 106/14.12 |
| 5,015,534 | A | 5/1991 | Kampe et al. | |
| 5,089,182 | A | 2/1992 | Findeisen et al. | |
| 5,480,931 | A | 1/1996 | Hock et al. | |
| 5,541,006 | A | 7/1996 | Conley | |
| 5,662,183 | A * | 9/1997 | Fang | 175/374 |
| 6,022,508 | A * | 2/2000 | Berns | 419/6 |
| 6,063,502 | A * | 5/2000 | Sue et al. | 428/469 |
| 6,287,360 | B1 | 9/2001 | Kembaiyan et al. | |
| 6,436,519 | B2 | 8/2002 | Holzschuh | |
| 6,908,688 | B1 | 6/2005 | Majagi et al. | |
| 8,211,203 | B2 | 7/2012 | Sheng et al. | |
| 2009/0260893 | A1 | 10/2009 | Sheng et al. | |

* cited by examiner

*Primary Examiner* — Cathleen Hutchins

(57) ABSTRACT

A matrix powder for forming a matrix bit body, wherein the matrix powder includes: a plurality of carbide particles; and a plurality of first metal binder particles having an aspect ratio of at least about 3. Drill bits formed from metal binder particles having an aspect ratio of at least about 3 and methods of forming such bits.

20 Claims, 4 Drawing Sheets

INFILTRATED CARBIDE MATRIX BODIES USING METALLIC FLAKES

CROSS-REFERENCE TO RELATED APPLICATIONS

This application claims priority to U.S. Provisional Application No. 61/153,142, filed Feb. 17, 2009, which is hereby incorporated by reference in its entirety.

BACKGROUND OF INVENTION

1. Field of the Invention

Embodiments disclosed herein relate generally to matrix bodies of rock bits and other cutting or drilling tools.

2. Background Art

Polycrystalline diamond compact ("PDC") cutters are known in the art for use in earth-boring drill bits. Typically, bits using PDC cutters include an integral bit body which may be made of steel or fabricated from a hard matrix material such as tungsten carbide (WC). A plurality of PDC cutters are mounted along the exterior face of the bit body in extensions of the bit body called "blades." Each PDC cutter has a portion which typically is brazed in a recess or pocket formed in the blade on the exterior face of the bit body.

The PDC cutters are positioned along the leading edges of the bit body blades so that as the bit body is rotated, the PDC cutters engage and drill the earth formation. In use, high forces may be exerted on the PDC cutters, particularly in the forward-to-rear direction. Additionally, the bit and the PDC cutters may be subjected to substantial abrasive forces. In some instances, impact, vibration, and erosive forces have caused drill bit failure due to loss of one or more cutters, or due to breakage of the blades.

While steel body bits may have toughness and ductility properties which make them resistant to cracking and failure due to impact forces generated during drilling, steel is more susceptible to erosive wear caused by high-velocity drilling fluids and formation fluids which carry abrasive particles, such as sand, rock cuttings, and the like. Generally, steel body PDC bits are coated with a more erosion-resistant material, such as tungsten carbide, to improve their erosion resistance. However, tungsten carbide and other erosion-resistant materials are relatively brittle. During use, a thin coating of the erosion-resistant material may crack, peel off, or wear, exposing the softer steel body which is then rapidly eroded. This can lead to loss of PDC cutters as the area around the cutter is eroded away, causing the bit to fail.

Tungsten carbide or other hard metal matrix body bits have the advantage of higher wear and erosion resistance as compared to steel bit bodies. The matrix bit generally is formed by packing a graphite mold with tungsten carbide powder and then infiltrating the powder with a molten copper-based alloy binder. There are several types of tungsten carbide that have been used in forming matrix bodies, including macrocrystalline tungsten carbide, cast tungsten carbide, carburized (or agglomerated) tungsten carbide, and cemented tungsten carbide. Tungsten carbide may be in the form of spherical pellets or crushed particles. Macrocrystalline tungsten carbide is essentially stoichiometric WC which is, for the most part, in the form of single crystals; however, some large crystals of macro-crystalline WC are bi-crystals. Carburized tungsten carbide has a multi-crystalline structure, i.e., they are composed of WC agglomerates.

Cast tungsten carbide, on the other hand, is formed by melting tungsten metal (W) and tungsten monocarbide (WC) together such that a eutectic composition of WC and $W_2C$, or a continuous range of compositions therebetween, is formed. Cast tungsten carbide typically is frozen from the molten state and comminuted to a desired particle size. The last type of tungsten carbide, which has been typically used in hardfacing, is cemented tungsten carbide, also known as sintered tungsten carbide. Sintered tungsten carbide comprises small particles of tungsten carbide (e.g., 1 to 15 microns) bonded together with cobalt. Sintered tungsten carbide is made by mixing organic wax, tungsten carbide and cobalt powders, pressing the mixed powders to form a green compact, and "sintering" the composite at temperatures near the melting point of cobalt. The resulting dense sintered carbide can then be crushed and comminuted to form particles of sintered tungsten carbide for use in hardfacing.

Bit bodies formed from either cast or macrocrystalline tungsten carbide or other hard metal matrix materials, while more erosion resistant than steel, lack toughness and strength, thus making them brittle and prone to cracking when subjected to impact and fatigue forces encountered during drilling. This can result in one or more blades breaking off the bit causing a catastrophic premature bit failure. The formation and propagation of cracks in the matrix body may result in the loss of one or more PDC cutters. A lost cutter may abrade against the bit, causing further accelerated bit damage. However, bits formed with sintered tungsten carbide may have sufficient toughness and strength for a particular application, but may lack other mechanical properties, such as erosion resistance. Thus, previous efforts have instead relied on combinations of materials to achieve a balance of properties. Additionally, use of materials having wide particle size distributions have been relied upon so as to achieve a close packing of the carbide wear particles to increase wear resistance.

Accordingly, there exists a need for a new matrix body composition for drill bits which has high strength and toughness, resulting in improved ability to retain blades and cutters, while maintaining other desired properties such as wear and erosion resistance.

SUMMARY OF INVENTION

In one aspect, embodiments disclosed herein relate to a matrix powder for forming a matrix bit body, wherein the matrix powder includes a plurality of carbide particles; and a plurality of first metal binder particles having an aspect ratio of at least about 3.

In another aspect, embodiments disclosed herein relate to a drill bit that includes a bit body having a plurality of blades extending radially therefrom, at least a portion of the bit body formed from a matrix powder composition comprising: a plurality of carbide particles; and a plurality of first metal binder particles having an aspect ratio of at least about 3; and at least one cutting element for engaging a formation disposed on at least one of the plurality of blades.

In another aspect, embodiments disclosed herein relate to a drill bit that includes a bit body having a plurality of blades extending radially therefrom, at least a portion of the bit body comprising a carbide phase and at least two binder phases, a first binder phase comprising an aspect ratio of at least about 3 and a second binder phase surrounding the carbide phase and the first binder phase; and at least one cutting element for engaging a formation disposed on at least one of the plurality of blades.

In yet another aspect, embodiments disclosed herein relate to a method of forming a matrix bit body that includes loading a matrix powder comprising a plurality of carbide particles and a plurality of first metal binder particles having an aspect ratio of at least about 3 into a mold cavity; and heating the mold contents to form a matrix bit body.

Other aspects and advantages of the invention will be apparent from the following description and the appended claims.

DETAILED DESCRIPTION

Figure 1A:
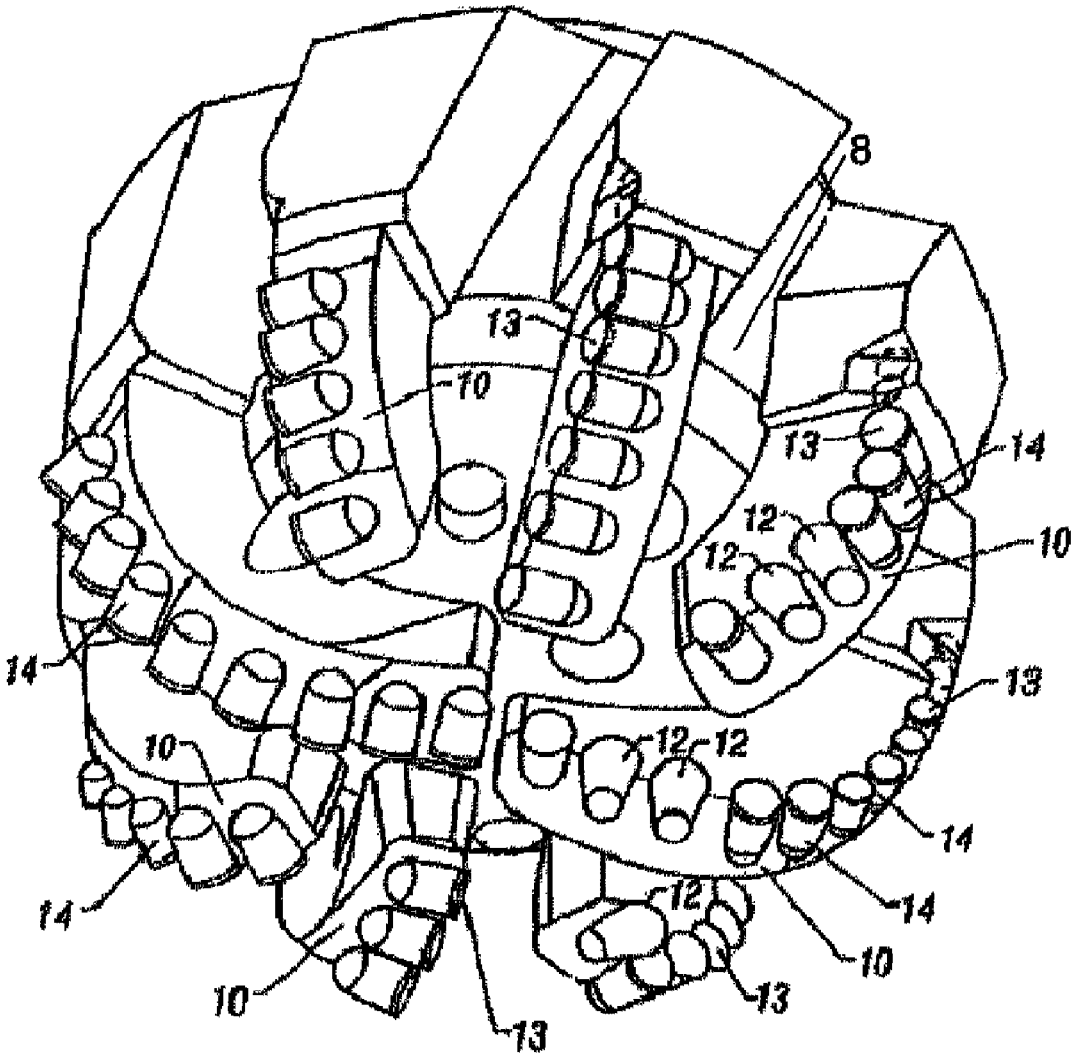
FIG. 1A is a perspective view of an earth boring PDC drill bit body with a plurality of cutters disposed thereon according to an embodiment.

Embodiments of the present disclosure provide for matrix compositions suitable for forming bit bodies. In addition, embodiments of the present disclosure provide matrix bodies which are formed from a matrix powder of carbide particles and metallic flakes which is then infiltrated by suitable metals or alloys as infiltration binders. As used herein, the term "flake" refers to a metal material that has a high aspect ratio, i.e., length is at least three times the thickness. Such a matrix body has high strength and toughness while maintaining desired braze strength and wear resistance.

The invention is based, in part, on the determination that the life of a matrix bit body is related to the body's strength, toughness, and resistance to wear and erosion. For example, cracks often occur where the cutters (typically polycrystalline diamond compact—"PDC" cutters) are secured to the matrix body, or at the base of the blades. The ability of a matrix bit body to maintain the blades is measured in part by its transverse rupture strength. The drill bit is also subjected to varying degrees of impact and fatigue loading while drilling through earthen formations of varying hardness. It is important that the bit possesses adequate toughness to withstand such impact and fatigue loading. Additionally, during drilling processes, drilling fluids, often laden with rock cuttings, can cause erosion of the bit body. Thus, it is also important that the matrix body material be sufficiently erosion resistant to withstand degradation caused by the surrounding erosive environment.

In particular, while conventional attempts to improve the wear properties of matrix bit bodies used wide particle size distributions to increase the packing efficiency of the wear resistant carbide particles (by filling smaller carbide particles into the spaces between larger carbide particles resulting in greater carbide-carbide particle contact), the present disclosure is instead directed to techniques for balancing toughness and wear resistance by increasing the mean free path between primary carbide particles through use of metallic binder flakes. Additionally, when using spherical binder powder less than 20 micrometers, such spherical particles also pack efficiently, thus the spherical binder particles must be added in excess of 12 percent by weight in order to detect any increase in spacing between the particles. However, when adding such large quantities of binder, the resulting body observed a marked decrease in wear resistance. Use of binder in flake-form, as compared to spherical particles, result in (greater and more uniform) spacing between primary carbide particles, more even distribution of carbide particles throughout the binder phase, less carbide-carbide particle contact, and thus more efficient use of binder phase, resulting in increased toughness without loss of wear resistance.

The relative distribution of carbide particles in the binder phase of the matrix may be measured using several different methods. First, the distribution may be discussed in terms of carbide "contiguity," which is a measure of the number of carbide particles that are in direct contact with other carbide particles. Ideally, if complete distribution existed, the carbide to carbide contiguity would be 0% (i.e., no two carbide particles are in direct contact). Matrix bodies formed in accordance with the matrix powders of the present disclosure may possess a contiguity significantly less than that achieved for a typical matrix body.

The carbide contiguity may be determined as follows:

$$C_{C\text{-}C}=(2P_{C\text{-}C})/(2P_{C\text{-}C}+P_{C\text{-}M}) \quad \text{(Eq. 1)}$$

where $P_{C\text{-}C}$ equals the total number of contiguous points of carbide along the horizontal lines of a grid placed over a sample photo, and $P_{C\text{-}M}$ equals the total number of points where carbide particles contact matrix. Second, the carbide distribution may be discussed in terms of the mean free path, which represents the mean distance between carbide particles. Using this metric, the larger the mean free path (for a given carbide concentration) the more evenly distributed the carbide particles are. In accordance with embodiments of the present disclosure, an improved mean free path may result from the particle size distributions used in forming matrix body bits.

To decrease carbide contiguity and increase mean free path, a better spacing between particles (less efficient packing) is desired. Thus, while conventional wisdom in matrix bit design has indicated that a wide particle size distribution is desirable to fill "pore" spaces between larger carbide particles with smaller carbide particles (increasing packing efficiency) in order increase wear resistance, the present disclosure uses a matrix powder composition that includes metallic flakes therein, resulting in a greater mean free path and lower packing efficiency. When a bit is subjected to typical loads during drilling, reduction in carbide-carbide contact may result in a tougher bit less prone to cracking (and propagation of cracking). Moreover, inclusion of the flakes may also provide crack deflection properties.

Matrix powders are typically formed from a combination of carbide particles and binder particles (conventionally generally spherical or otherwise having an average aspect ratio of about 1). However, in accordance with embodiments of the present disclosure, at least a portion of the binder particles may be flakes having an aspect ratio of at least about 3. In various embodiments, flakes having a higher aspect ratio of at least about 5, at least about 10, or at least about 20 may alternatively be used.

Thus, the matrix powder may comprise a mixture of tungsten carbide particles and metallic binder particles. The binder particles (formed of metallic flakes alone or in combination with generally spherical particles) may be present in an amount ranging from about 6 to 16 percent by weight (% w) of the powder. In a particular embodiment, the binder content may range from about 6% w to 12% w, with metallic flakes comprising from about 2% w to 12% w of the powder and the balance of binder particles being generally spherical particles. As used herein "generally spherical" referring to particles having an average aspect ratio of about 1, i.e., between 0.95 and 1.05, and as such may include particles that are angularly shaped as well as perfectly spherical as well as shapes in between. One skilled in the art would appreciate that the desirable amount of flake may depend on the particular application, for example, the carbides used and the relative need for improvement in toughness.

Such metallic binders may include nickel, cobalt, and iron, which are typically used as binder powders, as well as other metals, such as zinc, stainless steel, etc. For example, commercially available metallic flakes from Novamet Specialty Products Corporation (Wyckoff, N.J.) include nickel, stainless steel, and zinc flakes. However, no limitation on the types of metals which may be used is intended on the scope of the present disclosure. Rather, one skilled in the art would appreciate that any metallic particle having the high aspect ratios described herein may be useful in the matrix powder compositions.

Further, some examples of particle size dimensions for the flakes which may be used include lengths ranging from 10 to 75 microns and thicknesses ranging from 0.3 to 5 microns. However, one skilled in the art would appreciate that size may depend on the relative carbide particle size as well as the desired aspect ratios.

In addition to the binder particles, the matrix powder composition may also include various combinations of carbide particles to provide wear resistance. Such carbides may include macrocrystalline tungsten carbide, cast tungsten carbide (spherical or crushed), sintered tungsten carbide (spherical or crushed), and/or carburized tungsten carbide.

As discussed above, one type of tungsten carbide is macrocrystalline carbide. This material is essentially stoichiometric WC in the form of single crystals. Most of the macrocrystalline tungsten carbide is in the form of single crystals, but some bicrystals of WC may form in larger particles. The manufacture of macrocrystalline tungsten carbide is disclosed, for example, in U.S. Pat. Nos. 3,379,503 and 4,834,963, which are herein incorporated by reference.

Another form of tungsten carbide is cemented tungsten carbide (also known as sintered tungsten carbide), which is a material formed by mixing particles of tungsten carbide, typically monotungsten carbide, and cobalt particles, and sintering the mixture. Methods of manufacturing cemented tungsten carbide are disclosed, for example, in U.S. Pat. Nos. 5,541,006 and 6,908,688, which are herein incorporated by reference. Sintered tungsten carbide particles are commercially available in two basic forms: crushed and spherical (or pelletized). Crushed sintered tungsten carbide is produced by crushing sintered components into finer particles, resulting in more irregular and angular shapes, whereas pelletized sintered tungsten carbide is generally rounded or spherical in shape.

Briefly, in a typical process for making cemented tungsten carbide, a tungsten carbide powder having a predetermined size (or within a selected size range) is mixed with a suitable quantity of cobalt, nickel, or other suitable binder. The mixture is typically prepared for sintering by either of two techniques: it may be pressed into solid bodies often referred to as green compacts, or alternatively, the mixture may be formed into granules or pellets such as by pressing through a screen, or tumbling and then screened to obtain more or less uniform pellet size. Such green compacts or pellets are then heated in a controlled atmosphere furnace to a temperature near the melting point of cobalt (or the like) to cause the tungsten carbide particles to be bonded together by the metallic phase. Sintering globules of tungsten carbide specifically yields spherical sintered tungsten carbide. Crushed cemented tungsten carbide may further be formed from the compact bodies or by crushing sintered pellets or by forming irregular shaped solid bodies.

The particle size and quality of the sintered tungsten carbide can be tailored by varying the initial particle size of tungsten carbide and cobalt, controlling the pellet size, adjusting the sintering time and temperature, and/or repeated crushing larger cemented carbides into smaller pieces until a desired size is obtained. In one embodiment, tungsten carbide particles (unsintered) having an average particle size of between about 0.2 μm to about 20 μm are sintered with cobalt to form either spherical or crushed cemented tungsten carbide. In a preferred embodiment, the cemented tungsten carbide is formed from tungsten carbide particles having an average particle size of about 0.8 μm to about 5 μm. In some embodiments, the amount of cobalt present in the cemented tungsten carbide is such that the cemented carbide is comprised of from about 6 to 8 weight percent cobalt. In other embodiments, the cemented tungsten carbide used in the mixture of tungsten carbides to form a matrix bit body may have a hardness ranging from about 90 to 92 Rockwell A.

Cast tungsten carbide is another form of tungsten carbide and has approximately the eutectic composition between bitungsten carbide, $W_2C$, and monotungsten carbide, WC. Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. Thus, for example, the cast tungsten carbide used in the mixture of tungsten carbides may be comprised of from about 3.7 to about 4.2 weight percent carbon.

U.S. Pat. No. 6,287,360, which is assigned to the assignee of the present invention and is herein incorporated by reference, discusses the manufacture of carburized tungsten carbide. Carburized tungsten carbide, as known in the art, is a product of the solid-state diffusion of carbon into tungsten metal at high temperatures in a protective atmosphere. Carburized tungsten carbide grains are typically multi-crystalline, i.e., they are composed of WC agglomerates. The agglomerates form grains that are larger than individual WC crystals. These larger grains make it possible for a metal infiltrant or an infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of carbon infiltrated WC, with a total carbon content in the range of about 6.08% to about 6.18% by weight. Tungsten carbide grains designated as WC MAS 2000 and 3000-5000, commercially available from H. C. Stark, are carburized tungsten carbides suitable for use in the formation of the matrix bit body disclosed herein. The MAS 2000 and 3000-5000 carbides have an average size of 20 and 30-50 micrometers, respectively, and are coarse grain conglomerates formed as a result of the extreme high temperatures used during the carburization process.

Such carbide particles may be used in a variety of particle sizes. For example, in a particular embodiment, the matrix powder may have a mean particle size ranging from about 50 to about 840 microns. Further, carbide particles are often measured in a range of mesh sizes, for example −40+80 mesh. The term "mesh" actually refers to the size of the wire mesh used to screen the carbide particles. For example, "40 mesh" indicates a wire mesh screen with forty holes per linear inch, where the holes are defined by the crisscrossing strands of wire in the mesh. The hole size is determined by the number of meshes per inch and the wire size. The mesh sizes referred to herein are standard U.S. mesh sizes. For example, a standard 40 mesh screen has holes such that only particles having a dimension less than 420 μm can pass. Particles having a size larger than 420 μm are retained on a 40 mesh screen and particles smaller than 420 μm pass through the screen. Therefore, the range of sizes of the carbide particles is defined by the largest and smallest grade of mesh used to screen the particles. Carbide particles in the range of −16+40 mesh (i.e., particles are smaller than the 16 mesh screen but larger than the 40 mesh screen) will only contain particles larger than 420 μm and smaller than 1190 μm, whereas particles in the range of −40+80 mesh will only contain particles larger than 180 μm and smaller than 420 μm. Thus, use of mesh screening may allow for an easy determination of particle size distribution.

In one embodiment, a relatively uniform sized matrix powder (having a particle size distribution of ±20% or less of a median particle size) may be used, such as that disclosed in U.S. Patent Publication No. 2009/0260893A1. In such an embodiment, exemplary mesh sizes may include −230+325, −200+270, −170+230, −140+200, −120+170, −100+140, −80+120, −70+100, −60+80, −50+70. Further, one skilled in the art would appreciate that uniformly sized matrix powder may be taken from either end of the size spectrum, including fine or coarse particles. In a particular embodiment, carbide particles having a particle size distribution of ±20% or less of a median particle size of at least 100 microns may be used.

However, in other embodiments, a wider particle size distribution may be used. Thus, matrix powders have used powders having mesh sizes as broad as −60+625 mesh (or even broader), with other alternative distributions including, for example, −325+625, −170+625, −60+325. Further, one of ordinary skill would recognize that the particle sizes and distribution of the particle sizes of the primary carbide particles may be selected to allow for a broad, uniform distribution, or a bimodal or multi-modal distribution, for example, depending on a particular application.

Thus, one skilled in the art would appreciate that the various tungsten carbides disclosed herein may be selected so as to provide a bit that is tailored for a particular drilling application. For example, the type (e.g., cast, cemented, or macrocystalline tungsten carbide), shape, and/or size of carbide particles used in the formation of a matrix bit body may affect the material properties of the formed bit body, including, for example, fracture toughness, transverse rupture strength, and wear and erosion resistance. In a particular embodiment, either spherical or crushed cast tungsten carbide may be used as the primary carbide in the matrix body of the present disclosure.

Infiltrant

In a formed bit body, the matrix powder of carbide particles and binder particles may be infiltrated by an infiltration binder. The term "infiltration binder" herein refers to a metal or an alloy used in an infiltration process to bond the various particles of tungsten carbide (and/or metallic flakes) together. Suitable metals include all transition metals, main group metals and alloys thereof. For example, copper, nickel, iron, and cobalt may be used as the major constituents in the infiltration binder. Other elements, such as aluminum, manganese, chromium, zinc, tin, silicon, silver, boron, and lead, may also be present in the infiltration binder. In one preferred embodiment, the infiltration binder is selected from at least one of nickel, copper, and alloys thereof. In another preferred embodiment, the infiltration binder includes a Cu—Mn—Ni—Zn alloy.

The matrix body material in accordance with embodiments of the invention has many applications. Generally, the matrix body material may be used to fabricate the body for any earth-boring bit which holds a cutter or a cutting element in place. Earth-boring bits that may be formed from the matrix bodies disclosed herein include PDC drag bits, diamond coring bits, impregnated diamond bits, etc. These earth-boring bits may be used to drill a wellbore by contacting the bits with an earthen formation.

Figure 1B:
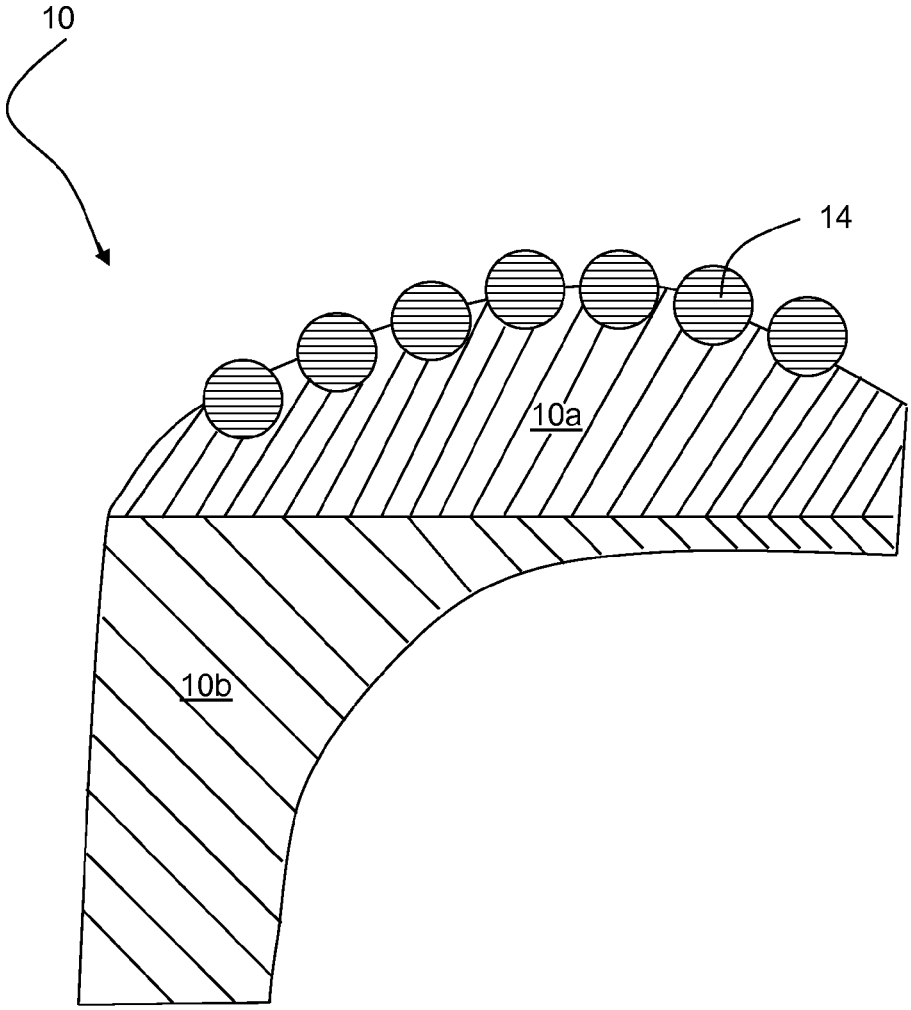
FIG. 1B shows a cross-sectional view of a blade in accordance with one embodiment.
Figure 2A:
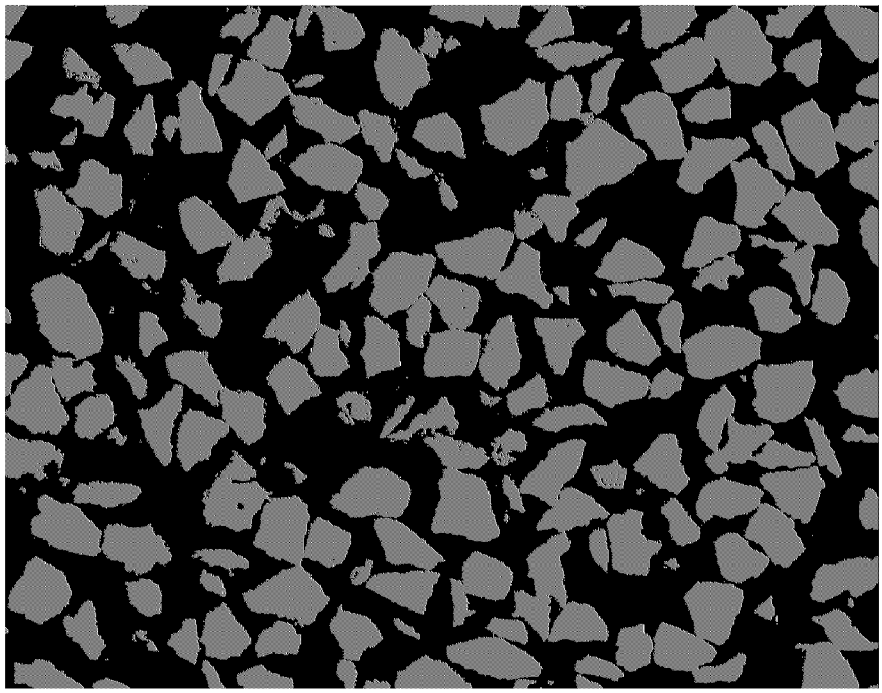
FIGS. 2A-B are SEM images of a matrix material in accordance with one embodiment.
Figure 2B:
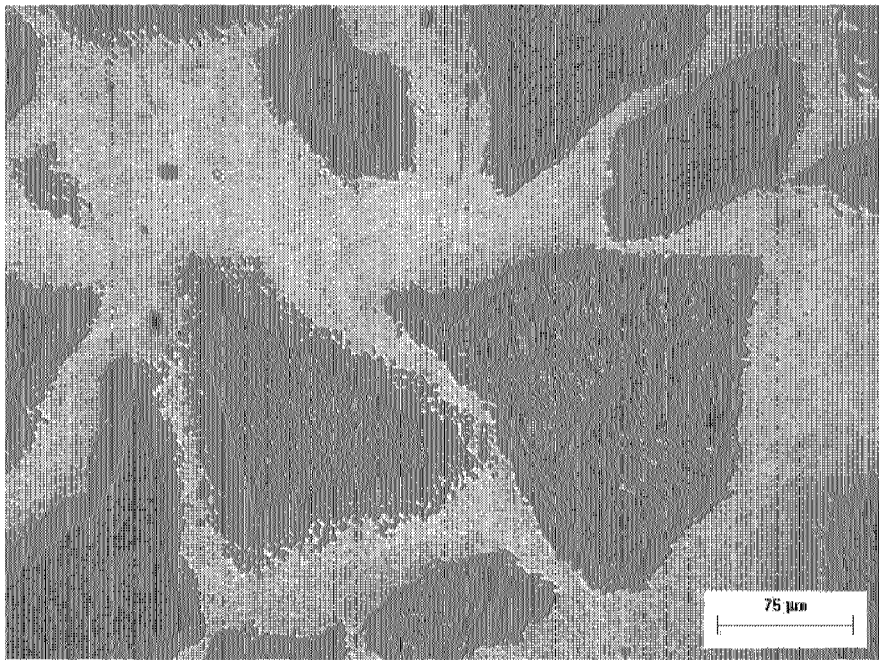

A PDC drag bit body manufactured according to one embodiment of the present disclosure is illustrated in FIGS. 1A-B. Referring to FIG. 1A, a PDC drag bit body 8 is formed with blades 10 at its lower end. A plurality of recesses or pockets 12 are formed in the faces to receive a plurality of conventional polycrystalline diamond compact cutters 14. The PDC cutters, typically cylindrical in shape, are made from a hard material such as tungsten carbide and have a polycrystalline diamond layer covering the cutting face 13. The PDC cutters are brazed into the pockets after the bit body has been made.

Figure 3A:
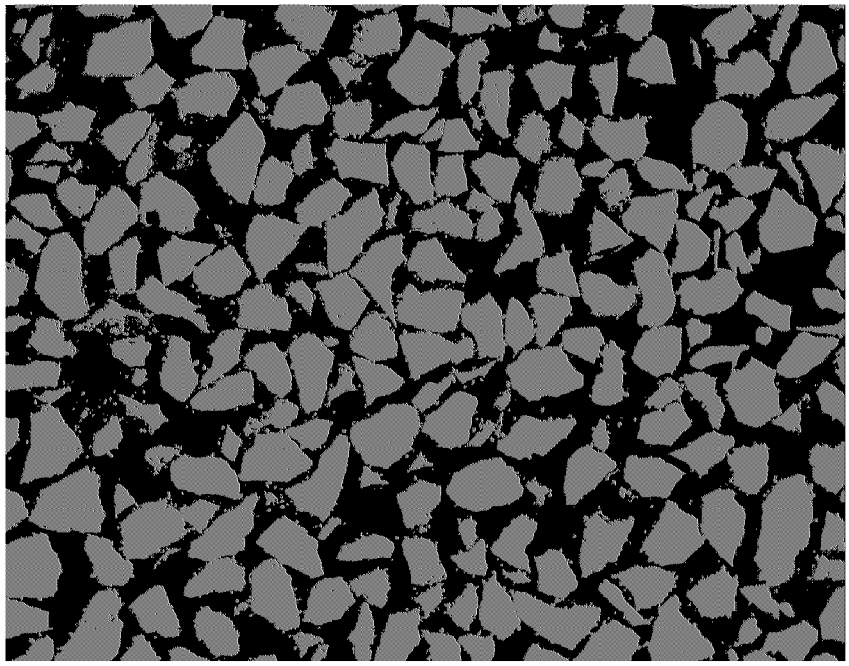
FIG. 3A Prior Art
FIGS. 3A-B are SEM images of a prior art matrix material.
Figure 3B:
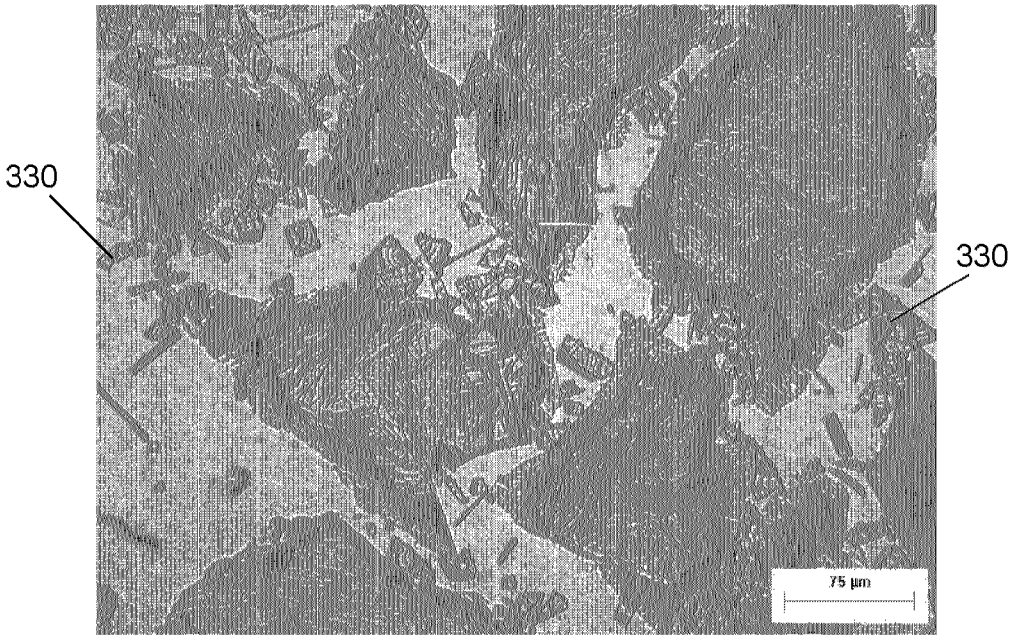
FIG. 3B Prior Art

Methods of making matrix bit bodies are known in the art and are disclosed for example in U.S. Pat. No. 6,287,360, which is assigned to the assignee of the present invention. These patents are hereby incorporated by reference. Briefly, infiltration processes that may be used to form a matrix bit body of the present disclosure may begin with the fabrication of a mold, having the desired body shape and component configuration. Matrix powder having metallic flakes distributed therein may be loaded into the mold in the desired location, i.e., blades, and the mass of particles may be infiltrated with a molten infiltration binder and cooled to form a bit body. Such a bit body formed with metallic flakes may have carbide particles distributed throughout with an increased mean free path as compared to traditional use of generally spherical binder particles. Referring to FIGS. 2A-B and 3A-B, scanning electron microscope images of an embodiment of the present disclosure (FIGS. 2A-B) is compared to a prior art matrix material (FIG. 3A-B). From the figures, it is apparent that the embodiments of the present disclosure achieve a greater mean free path as compared to bit bodies formed from generally spherical binder particles alone (in the matrix body). Both bodies were formed from −80+120 mesh cast carbide particles mixed with 8% by weight of the matrix powder nickel flakes (FIG. 2A) or nickel spherical particles (FIG. 3A). Further, FIGS. 2B and 3B also show that a reduction in eta-phase 330 may be achieved using the binder materials of the present disclosure. Eta phase forms as carbon is diffused from the carbide particles as part of the chemical reaction that forms between carbon, tungsten, and a metal, such as Fe, Co, or Ni. As carbon is diffused to the surface of the substrate, the result is a compound of tungsten, metal, and carbon in a carbon-depleted zone, which is referred to as eta phase. Because eta phase is very hard and brittle, it can result in a loss of strength, as well their presence reducing the mean free path between carbide particles.

Depending on the selection of the metallic binder flakes (and the melting point of the flakes in particular), the flakes may either remain solid during infiltration, or they may melt to react or alloy with the infiltrating binder. For a binder with a melting point greater than the infiltrant, the temperatures during infiltration may be controlled to be less than the melting point of the binder flakes so that the resulting bit has two discrete binder phases: a first binder phase dispersed (with carbide particles) through the second binder phase, the first binder phase having a discernable aspect ratio as described above. In such an embodiment, the solid flakes may serve to provide improved toughness (including through improved mean free path) and/or crack deflection properties, similar to that achieved with conventional fiber composite theories. Specifically, as a material is subjected to a load, and as a crack begins to propagate through the material, it is postulated that the metallic flakes may reinforce the bit body in one or more of several mechanisms. First, incorporation of flakes may allow for fiber or flake bridging, i.e., the bridging of the crack wake by the flakes. A toughening effect may also be achieved when the flakes either distributing load from the crack tip while remaining intact, debonding between the flakes and the surrounding material followed by pull-out, and/or fracture of the individual flakes followed by energy adsorption through pull-out of the broken flake. Further, when a crack propagates through a material, a flake being of greater strength than the surrounding material, depending on the orientation of the flake in the composite, crack propagation may be deflected away from the axis of highest stress to a less efficient plane directed by the longitudinal orientation of the flake. Moreover, the resulting bit body may have reduced erosion. Specifically, because the flakes are very thin, if/when they erode from the bit surface, only a small volume of material is lost as compared to spherical metal powders.

However, in another embodiment, a lower melting point material may be used. In such an embodiment, the flake particles may improve the mean free path between carbide particles, and thus toughness of the bit body. While the flake may melt during infiltration, it may be solid while a low-melting point infiltration alloy flows into the carbide-flake porous network. The flakes may serve to hold the carbides apart while the alloy fills the gaps therebetween. Depending on the time and temperature, the flakes may alloy or completely melt with the infiltrant alloy. Depending on selection of materials, a stronger or tougher metal may potentially be achieved from the alloying that may occur during infiltration than the strength or toughness of the infiltration binder alone.

Further, the matrix powders of the present disclosure may be used in a discrete portion of a bit body. For example, a second matrix powder may be loaded onto the matrix powder having the metallic flakes, such that a bit body (or blade, as shown in FIG. 1B) may be generally divided into two matrix regions: a first matrix region 10*a* formed from a matrix powder including metallic flakes combined with carbide particles (thus forming a low contiguity matrix region) and a second matrix region 10*b* formed from any type of tungsten or carbide particles without (or with lesser amounts) of such metallic flakes. In the embodiment shown, the first matrix region 10*a* forms a portion of the outer cutting portion of the blade, whereas the second matrix region 10*b* is layered thereon to form a portion of the base (and gage) of the blade. Further, there is no limitation on the number of or manner in which the layers may be provided in forming the bit.

While reference to a particular type of bit may have been made, no limitation on the present invention was intended by such description. Rather, the matrix bodies disclosed herein may specifically find use in PDC drag bits, diamond coring bits, impregnated diamond bits, etc. Thus, it is also within the scope of the present disclosure that at least one cutting element on a diamond impregnated drill bit may include, for example, at least one diamond impregnated insert. Further, any reference to any particular type of cutting element is also not intended to be a limitation on the present invention.

Advantageously, embodiments of the present disclosure may provide at least one of the following. The use of metallic binder flakes may allow for reduced carbide-carbide contact, a larger mean free path, and thus yielding a tougher bit. Moreover, certain embodiments may also provide for crack deflection properties. Such crack deflection properties may be particularly helpful for the repairability of a bit, to keep an existing crack from growing catastrophically.

Moreover, because the flakes may have less packing density, depending on the requirements of the particular application, a lower binder content may be used to achieve the same hardness and carbide spacing, as compared to prior art bits. Thus, by using metallic flakes, the resulting matrix body (or region) may be advantageously characterized as possessing toughness and strength without impairing wear and erosion resistance, and thus not susceptible to cracking and wear/erosion. While such flakes may be distributed throughout the formed matrix body, when flakes are located near a surface of the matrix body and are susceptible to erosion, only a small volume of binder, as compared to erosion of relatively spherical binder particles, may in fact be lost to erosion due to the thinness of the binder flakes. These advantages may lead to improved bit bodies for drag bits and other earth-boring devices in terms of longer bit life.

Another advantage is that nickel in flake form is usually cheaper on a per pound (~$4 per pound) basis than spherical nickel power, for example. This may provide a significant cost savings realized over a period of time. Further, due to the lower packing density of flake as compared to spherical metal particles, the flakes may have less tendency to segregate in the mold during mold vibration before infiltration. This may reduce the likelihood of a gradient in final metal chemistry after infiltration. A gradient in chemical makeup produces varying mechanical properties from the bit surface to the interior, the consequences of which are zones in the bit that are harder than others, which can result in bit cracking during heating and cooling during bit processing (brazing and welding operations or repair procedures).

Yet another advantage is that the metallic flakes may coat the carbide particles while mixing with a small percentage of polymer lubricant. The long and thin profile of a flake has a greater surface area contact to the carbide surface than a spherical metal particle would. Therefore, metal flakes may be used as a cheaper alternative to carbide particle coating processes such as CVD or electrolytic coatings.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A matrix powder for forming a matrix body, the matrix powder comprising:

a plurality of carbide particles; and a plurality of first metal binder particles, each particle of the plurality of first metal binder particles having an aspect ratio of at least about 3.

2. The matrix powder of claim 1, wherein the plurality of first metal binder particles comprise up to 12 wt % of the matrix powder.

3. The matrix powder of claim 1, wherein the plurality of first metal binder particles have an aspect ratio of at least about 10.

4. The matrix powder of claim 1, wherein the plurality of first metal binder particles comprise nickel and/or cobalt.

5. The matrix powder of claim 1, further comprising a plurality of second metal binder particles having an aspect ratio of about 1.

6. The matrix powder of claim 1, wherein the plurality of carbide particles comprise at least one of cast tungsten carbide, cemented tungsten carbide, and macrocrystalline tungsten carbide.

7. The matrix powder of claim 3, wherein the plurality of carbide particles comprise at least one of spherical cast tungsten carbide and crushed cast tungsten carbide.

8. The matrix powder of claim 1, wherein a mean particle size of the plurality of carbide particles ranges from 50 to 840 microns.

9. The matrix powder of claim 1, wherein the plurality of carbide particles have a particle size distribution of ±20% or less of a median particle size.

10. The matrix powder of claim 9, wherein the median particle size is at least 100 microns.

11. A drill bit, comprising:

a bit body having a plurality of blades extending radially therefrom, at least a portion of the bit body formed from a matrix powder composition comprising:

a plurality of carbide particles; and a plurality of first metal binder particles, each particle of the plurality of first metal binder particles having an aspect ratio of at least about 3; and at least one cutting element for engaging a formation disposed on at least one of the plurality of blades.

12. The drill bit of claim 11, wherein the plurality of first metal binder particles comprise up to 12 wt % of the matrix powder.

13. The drill bit of claim 11, wherein the plurality of first metal binder particles have an aspect ratio of at least about 10.

14. The drill bit of claim 11, wherein the plurality of first metal binder particles comprise nickel and/or cobalt.

15. The drill bit of claim 11, further comprising a plurality of second metal binder particles having an aspect ratio of about 1.

16. A drill bit, comprising:

a bit body having a plurality of blades extending radially therefrom, at least a portion of the bit body comprising a carbide phase and at least two binder phases, a first binder phase comprising particles having aspect ratios of at least about 3 and a second binder phase surrounding the carbide phase and the first binder phase; and at least one cutting element for engaging a formation disposed on at least one of the plurality of blades.

17. The drill bit of claim 16, wherein the plurality of first metal binder particles have an aspect ratio of at least about 10.

18. The drill bit of claim 16, wherein the first binder phase has a melting point greater than the second binder phase.

19. A method of forming a matrix body, comprising:

loading a matrix powder comprising a plurality of carbide particles and a plurality of first metal binder particles, each particle of the plurality of first metal binder particles having an aspect ratio of at least about 3 into a mold cavity; and heating the mold contents to form a matrix body.

20. The method of claim 19, further comprising:

infiltrating the mold contents with an infiltration binder, wherein the plurality of first metal binder particles have a melting point greater than the infiltration binder.

* * * * *